United States Patent [19]

Kasama et al.

[11] Patent Number: 5,048,519

[45] Date of Patent: Sep. 17, 1991

[54] MOUTHPIECE FOR DIVING

[76] Inventors: Masatoshi Kasama, No. 21-404, 1 ban, Hanamigawa, Chiba-shi, Chiba-ken, Japan; Yoshiaki Masubuchi, 92-10, Issiki, Hayamamachi, Miuragun, Kanagawaken, Japan

[21] Appl. No.: 618,334

[22] Filed: Nov. 21, 1990

[51] Int. Cl.[5] ..... A62B 9/00

[52] U.S. Cl. ..... 128/207.14; 128/201.11; 128/206.29; 128/207.17

[58] Field of Search ..... 128/201.11, 206.29, 128/207.14, 207.17, 200.24, 200.26, 201.27, 204.11, 207.11, 859, 860, 861, 862, 912, DIG. 26

[56] References Cited

U.S. PATENT DOCUMENTS 4,466,434 8/1984 Browstein ..... 128/207.14

4,862,903 9/1989 Campbell ..... 128/206.29

*Primary Examiner*—Edgar S. Burr

*Assistant Examiner*—Lisa E. Malvaso

*Attorney, Agent, or Firm*—Edwin E. Greigg; Ronald E. Greigg

[57] ABSTRACT

This invention relates to a mouthpiece for diving which can be attached to a regulator in scuba diving. The mouthpiece comprises a tubular air guide including first and second end portions and a pair of resilient supporting arms elastically provided contiguously of the left and right sides of the air guide second end portion. Stopper portions are provided on the resilient supporting arm portions and include side portions formed between these stopper portions and left and right outside walls of the air guide second end portion. The left and right side portions are movable so that they are opened when a person having small teeth marks bites the mouthpiece and are closed when a person having large teeth marks bites the mouthpiece. The stopper portion comes into pressure-contact with the outside wall of the inclined air guide portion, thus supporting the air guide portion.

4 Claims, 6 Drawing Sheets

MOUTHPIECE FOR DIVING

BACKGROUND OF THE INVENTION

This invention relates to a mouthpiece for diving attached to a regulator in scuba diving.

Hitherto, there is known an embodiment shown in FIGS. 10 and 11 as the mouthpiece of this kind.

The mouth piece 1 is formed by rubber, or synthetic resin material, etc. so as to have somewhat elasticity. The mouthpiece 1 includes a circumferential groove 3 for attaching a regulator (not shown) at one end portion of a tubular air guide portion 2. Further, the mouth piece 1 includes a pair of left and right supporting arm portions 4 and 4 supported by the upper and lower teeth and the lips of a diver at the other end portion thereof.

However, since the mouth piece 1 of the structure mentioned above is such that the left and right supporting arm portions 4 and 4 are formed extending in a swelling manner from the left and right central portions of the air guide portion 2 toward the outward direction, respectively, the thickness of the left and right extending portions 4*a* and 4*b* become large. Accordingly, such a conventional mouthpiece has drawbacks recited below.

(1) Since the left and right supporting arms 4 and 4 are fixedly provided contiguously to the air guide portion 2, this mouthpiece has less flexibility. Accordingly, such a mouthpiece cannot be widely used in correspondence with differences between sizes of teeth-marks of respective divers.

(2) When a force in one direction is exerted on the regulator during diving, that force is entirely applied to the supporting arm portions 4 of the mouth piece supported by the mouth as it is. Accordingly, the diver must firmly bite the mouth piece with upper and lower teeth of the diver.

SUMMARY OF THE INVENTION

With the drawbacks with the prior art stated above in view, an object of this invention is to provide a mouthpiece for diving which can be widely used in correspondence with differences between sizes of teeth-marks of respective divers, and which has an ability such that when a force in one direction is applied to the regulator during diving, that force is not entirely applied to the mouthpiece.

A mouthpiece for diving according to this invention comprises a tubular air guide portion provided at one end thereof with an engagement portion with which a regulator is engaged, and a pair of resilient supporting arm portions elastically provided contiguously to the left and right sides of the other end portion of the air guide portion and supported by the teeth and the lips of a diver.

The mouthpiece for diving according to this invention is further characterized in that stopper portions including side portions between the stopper portions and the left and right outside walls of the air guide portion are projected on the outer walls of the resilient supporting arm portion, respectively.

BRIEF DESCRIPTION OF THE DRAWINGS

FIG. 1 is a perspective view, FIG. 2 is a front view, FIG. 3 is a plan view, FIG. 4 is a back view, FIG. 5 is a left side view, FIG. 6 is a cross sectional view taken along the 6—6 line of FIG. 2, and FIG. 7 and 8 are explanatory views showing how the mouthpiece of this invention is used, respectively.

DESCRIPTION OF THE PREFERRED EMBODIMENT

This invention will now be described in detail in accordance with an embodiment shown in the attached drawings.

Figure 9:
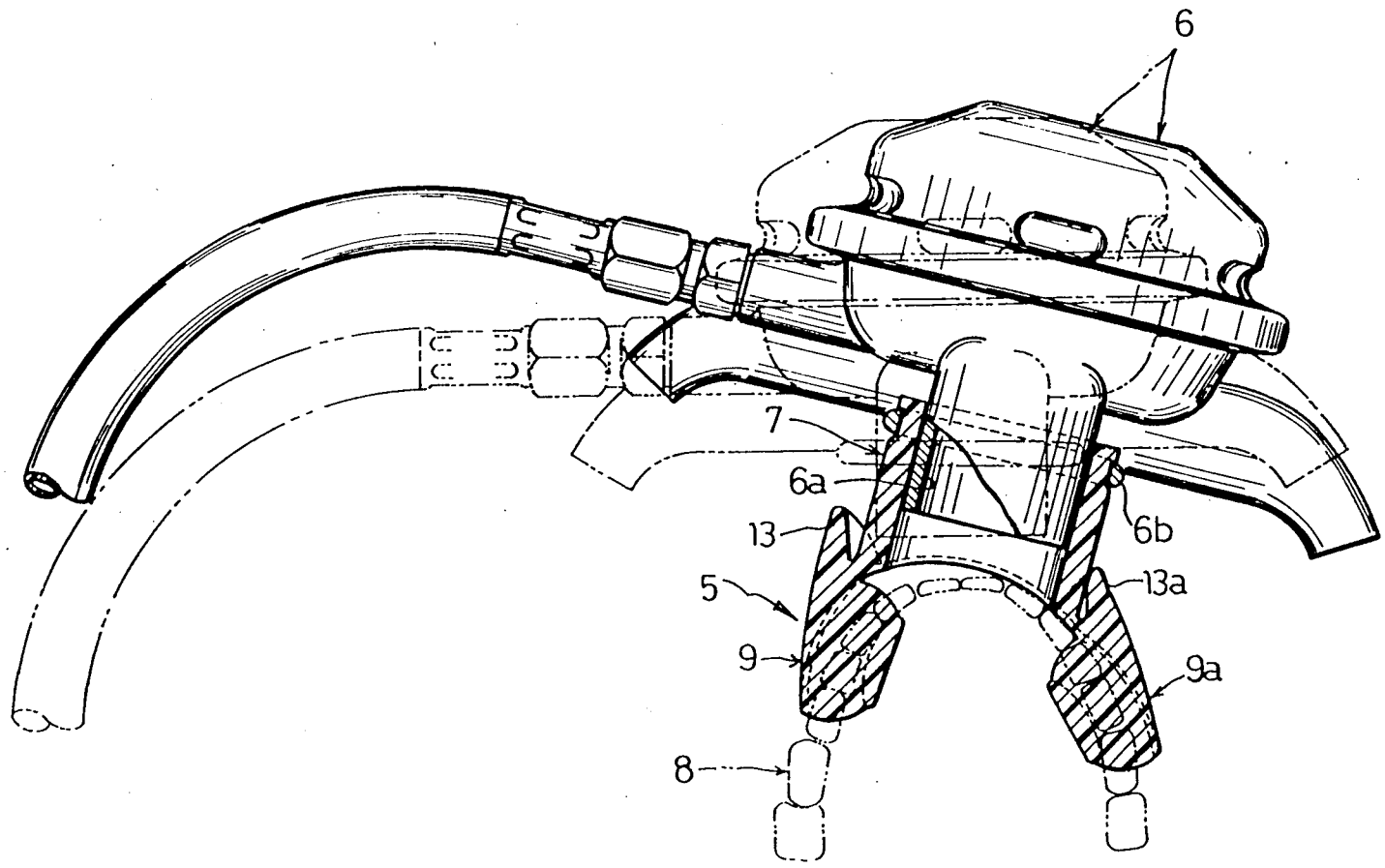
Figure 10:
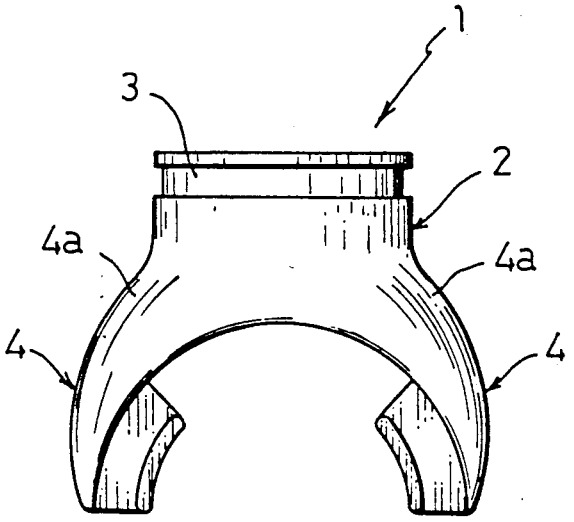
Fig. 10 PRIOR ART
FIGS. 10 and 11 are explanatory views showing an embodiment of the prior art.
Figure 11:
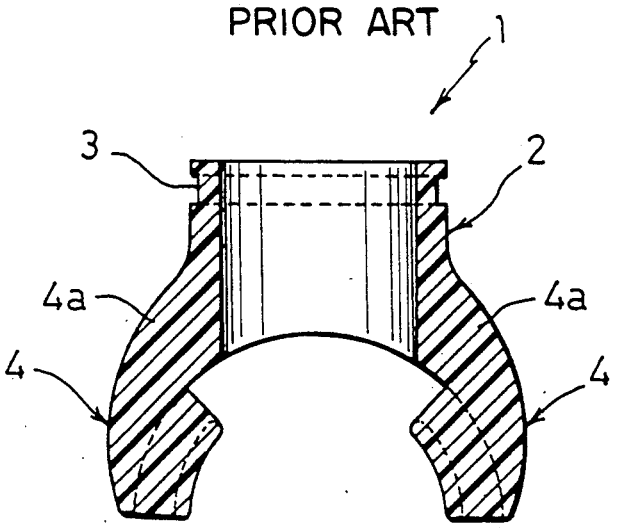
Fig. 11 PRIOR ART

Reference numeral 5 denotes a mouthpiece for diving, which is formed by synthetic resin, etc. The mouth piece 5 comprises, as shown in FIG. 9, an air guide portion 7 into which a tubular attachment portion 6*a* of a regulator 6 is fitted, and a pair of left and right resilient supporting arm portions 9 and 9*a* oppositely provided contiguously to left and right outside wall portions of the air guide portion 7 and supported by the teeth 8 and the lips of a diver.

The air guide portion 7 includes an elliptical air communicating or ventilation passage 10. Further, a circumferential groove 11 over which an engagement ring portion 6*b* of the regulator 6 is fitted is formed at an outer wall of one end portion of the air guide portion 7.

The left and right resilient supporting arm portions 9 and 9*a* are elastically provided contiguously to the left and right sides of the other end portion of the air guide portion 7, respectively.

On the outer wall of the left and right resilient supporting arm portions 9 and 9*a*, stopper portions 13 and 13*a* include side portions 12 and 12*a* which appear to form a V-shaped spacing formed between these stopper portions and the left and right outside walls of the air guide portion 7, respectively. These left and right stopper portions 13 and 13*a* are formed curved in a manner that the outside faces widen or move apart, while the inside faces are entirely in contact with the left and right outside walls of the air guide portion 7, respectively.

Figure 1:
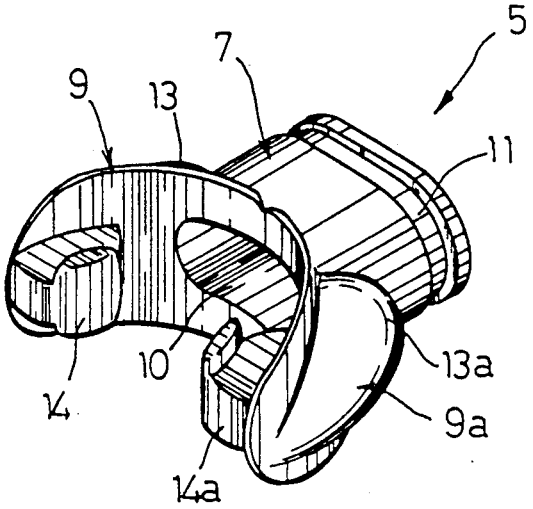
FIGS. 1 to 9 show an embodiment of this invention. More particularly.
Figure 2:
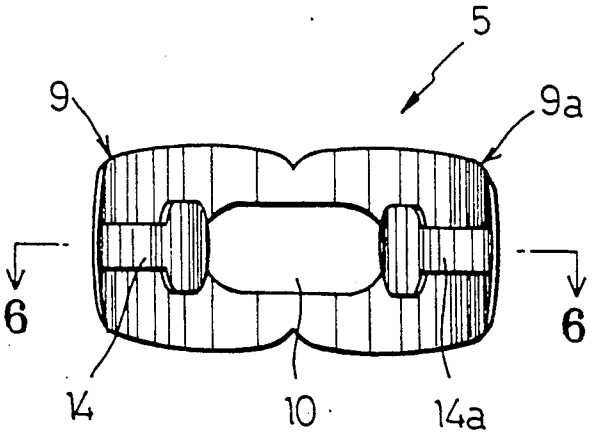
Figure 3:
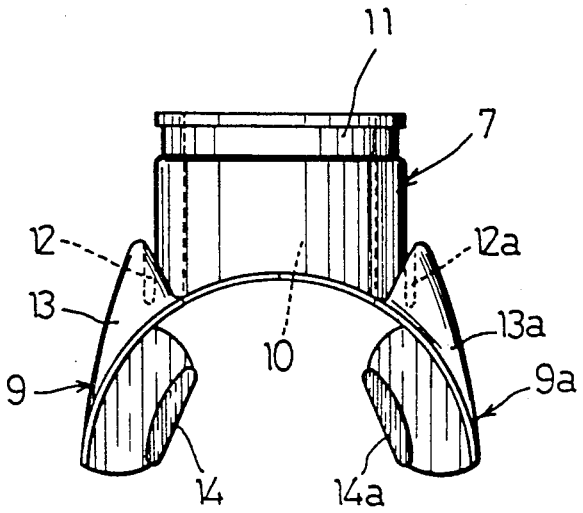
Figure 4:
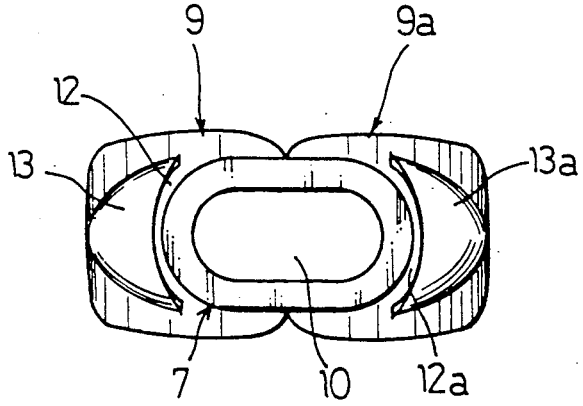
Figure 5:
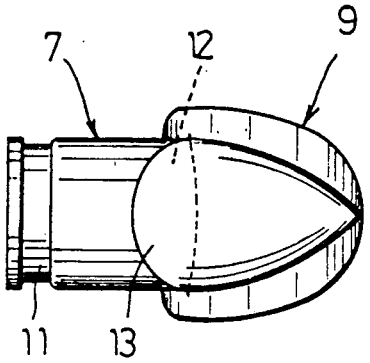
Figure 6:
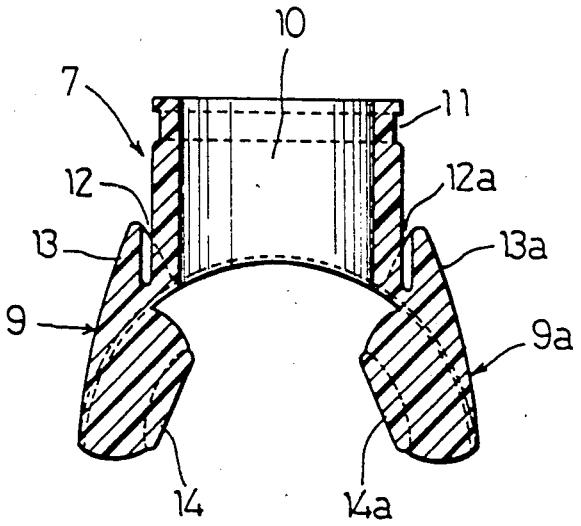

Reference numerals 14 and 14*a* denote left and right supporting portions oppositely formed on the inner walls of the resilient supporting arm portions 9 and 9*a* so that they are projected therefrom, and bitten by the upper and lower teeth 8, respectively. These supporting portions 14 and 14*a* are formed T-shaped when viewed from their end surfaces, as shown in FIG. 2, respectively.

In the construction stated above, as shown in FIG. 9, the mouthpiece 5 is fixedly attached by the tubular attachment portion 6*a* and the engagement ring portion 6*b* of the regulator 6.

Figure 7:
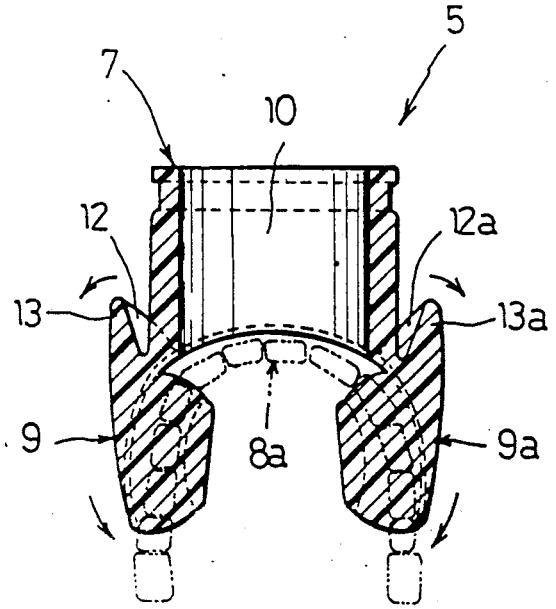

Thus,, when a person having small teeth-marks 8*a* bites the mouthpiece 5, the left and right side portions 12 and 12*a* of the mouthpiece 5 are opened as shown in FIG. 7. Namely, the mouth piece 5 is bent in a closing direction as a whole as indicated by an arrow. At this time, the left and right stopper portions 13 and 13*a* are spaced from the outside walls of the air guide portion 7, respectively.

Figure 8:
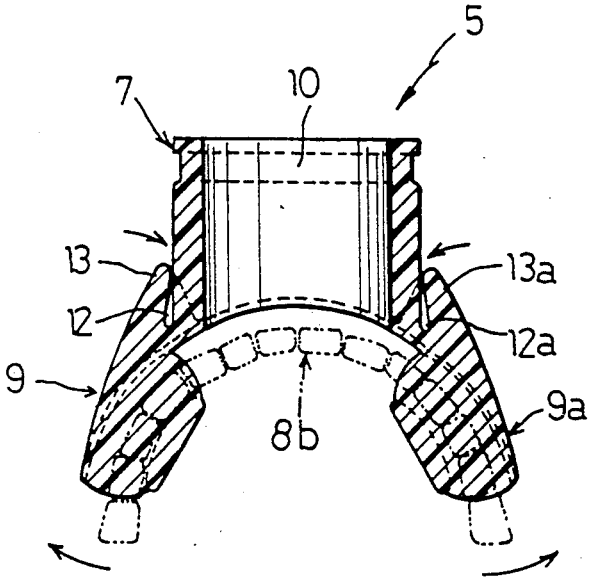

On the other hand, when a person having large teeth-marks 8*b* bites the mouth piece 5, the left and right side portions 12 and 12*a* of the mouth piece 5 are closed as shown in FIG. 8. Namely, the mouthpiece 5 is bent in an opening direction as a whole indicated by an arrow. At this time, the left and right stopper portions 13 and 13*a* come into contact with the left and right outside walls of the air guide portion 7, or are brought into states similar thereto, respectively.

Meanwhile, the stopper portions 13 and 13*a* of the mouthpiece 5 provide brake action under water.

Namely, as shown in FIG. 9, when a force in one direction is exerted on the regulator 6 during diving, the air guide portion 7 is inclined with respect to the left and right resilient supporting arms 9 and 9*a* supported by the teeth 8 so that it is not contrary to that force to the utmost. At this time, the air guide portion 7 is supported by the inclined stopper portion 13*a* in a pressure-contact state (brake action).

As is clear from the foregoing description, this invention provides the advantages recited below.

(1) Since the left and right resilient supporting arm portions are flexibly provided contiguously to the left and right sides of the other end portion of the air guide portion, respectively, even if there is any individual difference in size of the teeth-marks of divers, the left and right resilient supporting arm portions are flexibly opened and closed.

Accordingly, the diver can use the mouth piece irrespective of the size of his teeth-marks.

(2) Since the stopper portions including side portions formed between these stoppers and the left and right outside walls of the air guide portion are projected on the external surfaces of the resilient supporting arm portions, respectively, even if a force in one direction is applied to the regulator during diving, the regulator is readily inclined, thereby making it possible to reduce the resistance force of water. In addition, since any stopper comes into pressure-contact with the outside wall of the air guide portion, there is no possibility that the regulator is inclined to more of a degree than needed.

Accordingly, the diver can bite with ease the mouth piece during diving.

What is claimed is:

1. A mouthpiece for diving comprising:

a tubular air guide provided with first and second end portions including left and right outside walls, said first end portion forms an engagement portion with which a regulator is engaged, said second end portion extends from said first portion and includes a pair of resilient supporting arm portions flexibly supported contiguously to the left and right outside walls of said second end portion of said tubular air guide upon which the teeth and the lips of a diver are supported when in use, each of said resilient supporting arm portions include stopper portions, said stopper portions including side portions formed between said stopper portions and the left and right outside walls of said first end portion of said sir guide, said stopper portions project along the left and right outside walls of said first end portion with a spacing therebetween, and said resilient supporting arms include means on an inside wall which are grasped by the teeth.

2. A mouthpiece for diving as set forth in claim 1, in which said means which is grasped by one's teeth includes T-shaped supporting means integral with an inside surface of said supporting arm portions for supporting a diver's teeth.

3. A mouthpiece for diving as set forth in claim 1, in which said pair of resilient supporting arms are movable in a plane relative to said left and right outside walls of said first end portion of said air guide to provide a smaller or wider spacing between said resilient supporting arm portions.

4. A mouthpiece for diving as set forth in claim 2, in which said pair of resilient supporting arms are movable in a plane relative to said left and right outside walls of said first end portion of said air guide to provide a smaller or wider spacing between said resilient supporting arm portions.

* * * * *